US006382069B1

(12) United States Patent
Haughom et al.

(10) Patent No.: US 6,382,069 B1
(45) Date of Patent: May 7, 2002

(54) DEMINING METHOD AND DEDICATED DEMINING VEHICLE

(75) Inventors: Jann Kjell Haughom, Tonstad (NO); Håkan Svensson, Karlskoga; Bengt Karlén, Degerfors, both of (SE)

(73) Assignee: Bofors AB (SE)

( * ) Notice: Subject to any disclaimer, the term of this patent is extended or adjusted under 35 U.S.C. 154(b) by 0 days.

(21) Appl. No.: 09/445,015

(22) PCT Filed: Jun. 15, 1998

(86) PCT No.: PCT/SE98/01150

§ 371 Date: Feb. 25, 2000

§ 102(e) Date: Feb. 25, 2000

(87) PCT Pub. No.: WO98/58224

PCT Pub. Date: Dec. 23, 1998

(30) Foreign Application Priority Data

Jun. 16, 1997 (SE) ..... 9702282

(51) Int. Cl.[7] ..... F41H 11/12; F41H 11/16
(52) U.S. Cl. ..... 89/1.13
(58) Field of Search ..... 89/1.13

(56) References Cited

U.S. PATENT DOCUMENTS

| | | | | |
|---|---|---|---|---|
| 3,498,177 A | | 3/1970 | Moro | |
| 3,771,413 A | * | 11/1973 | Sieg et al. | 89/1.13 |
| 5,442,990 A | * | 8/1995 | Krohn | 89/1.13 |

FOREIGN PATENT DOCUMENTS

| | | | | |
|---|---|---|---|---|
| DE | 23 18 055 | | 3/1975 | |
| NO | WO 95/24604 | * | 9/1995 | F41H/11/16 |
| WO | WO 96/37752 | | 11/1996 | |
| WO | WO 96/37753 | | 11/1996 | |

* cited by examiner

*Primary Examiner*—Charles T. Jordan
*Assistant Examiner*—John W. Zerr
(74) *Attorney, Agent, or Firm*—Connolly, Bove Lodge & Hutz LLP

(57) ABSTRACT

The present invention relates to a method and a device for clearing mines deployed on or in the ground using a mechanical demining vehicle operating on the rotary cultivator principle in a way that prevents major damage to the demining tool (6) or the engine (5 ). The basis of the present invention is that the demining tool (6) is enabled to deflect away from large mine detonations whereby the demining tool (6) moves in coordination with the engine so that neither it nor its drive function suffers any major damage.

15 Claims, 4 Drawing Sheets

DEMINING METHOD AND DEDICATED DEMINING VEHICLE

BACKGROUND OF THE INVENTION

The present invention relates to a method for rapid clearance of landmines located freely on the surface of the ground or buried in the upper ground layer whereby major damage to the demining vehicle and the demining tool mounted thereon is avoided. The present invention also incorporates a dedicated design of the demining vehicle.

The expression 'landmines' used herein denotes both smaller types of anti-personnel (AP) mines as well as the significantly larger anti-vehicle and anti-tank mines.

As there is usually a mix of both types of mines in a mined zone one must be prepared to neutralise both types when demining mined zones.

To be able to neutralise buried mines of the above types the ground needs to be comprehensively worked down to a sufficient depth in the upper ground layer. Previously, most interest has been focused on military requirements for demining vehicles for rapid breaching of routes through minefields, while the final demining of minefields after the end of a conflict has been performed by the time consuming method of using probes or electromagnetic mine detectors. The latter are very reliable provided individual mines each contain at least some quantity of metal, but the number of false alarms owing to metal fragments in the ground can be considerable, especially in areas where battles have previously been fought. Electromagnetic mine detectors are, in fact, highly sensitive and require, moreover, trained personnel. This type of mine clearance is thus very time consuming and labour intensive. as is the use of probes, and is also very costly.

In latter years, however, various quarters have started to show an interest in developing mechanical mine clearance vehicles that operate in a similar way to mechanical rotary cultivators and which, in suitable ground, have displayed a capability for clearing considerably greater areas per unit of time than has been possible previously.

Demining devices operating like rotary cultivators—by means of toothed rollers, demining discs or some other type of tool—either 'chew' or tear apart any mines in their path or cause them to detonate either in or under the demining tool. The larger types of mines, however, often cause such extensive damage to the demining tool that it must be repaired or replaced before demining operations can continue. The mounting and/or driveline for the demining tool may also be damaged and may be much more difficult to rectify than the tool itself which can usually be replaced fairly easily, but each work stoppage should preferably be avoided, especially if they involve costs for irreparable materiel.

The desire to avoid as far as possible damage to the demining tool, its mount and drive function must, however, be combined with enablement of a sufficiently large mass and force on the demining tool that it constantly reaches the desired, pre-determined operating depth. This places major—and partially contradictory—demands on the design.

SUMMARY OF INVENTION

The present invention now offers a combined demining tool and drive-motor mount for demining vehicles of the type herein mentioned that enables a large mass to be exerted on the demining tool while also minimising damage to the demining tool in the event of any large mine detonations in or under the tool, and that also prevents damage to the tool's drive function and engine.

As claimed in the present invention the demining vehicle's demining tool that operates in the ground similar to a rotary cultivator or, to be more precise, the mounts which carry the rotating demining tool are interconnected with the engine that drives the tool, and in the present case also drives the demining vehicle, to form a longitudinal (in relation to the vehicle) interactive unit. This unit in turn is mounted on the chassis of the demining vehicle via a torsion shaft transverse to the longitudinal axis of the chassis which shaft is located at the same height as the engine and is so located longitudinally that a necessary part of its dead weight bears on the demining tool. The angle setting of the complete unit relative to the ground surface is in turn determined by dedicated devices that lift the ends of the demining tool that bear most of the dead weight of the unit. The tilt of the demining tool relative to the ground surface is what determines the operating depth of the tool in the ground. The mounting of the demining tool / engine unit around a torsional shaft transverse to the longitudinal axis of the chassis in combination with a lifting function journalled at the ends of the demining tool that bear most of the combined weight of the unit mean in turn that any mine detonation in or under the demining tool initiates an upwards swing of the demining tool / engine unit which will minimise the damage effect of the detonation on the demining tool itself, its mounts and drive function. The complete basic concept thus provides a method for reducing the effect of a mine detonation in or under the demining tool by means of a weighted-load counter-spring of the active system in which the engine—which must be present and must provide high output—constitutes the main constituent of the counter-weight. As the demining tool and the engine constitute a coordinate unit in the longitudinal axis of the demining vehicle, the load on the drive coupling between the engine and demining tool is also reduced.

As claimed in a preferred variant of the demining vehicle in the present invention, the demining vehicle is equipped with further devices for as far as possible eliminating the negative effects of any mine detonations on the demining tool and its mounts and engine.

The demining tool mounts in the inverted cradle supporting the demining tool have thus been designed to be spring-loaded so that some of the stresses on the demining tool caused by any mine detonation can be assimilated immediately by the mounts.

Furthermore, the demining tool cradle is united with the engine of the above mentioned coordinate unit journalled around the transverse shaft by shock absorbers mounted between them with a great capability for assimilating stresses caused by any mine detonations.

BRIEF DESCRIPTION OF THE DRAWINGS

The method and device as claimed in the present invention is defined in the Patent Claims below, and shall now be described in more detail with reference to the appended figures:

DETAILED DESCRIPTION

Corresponding parts on the various figures have the same designation on each figure.

Figure 1:
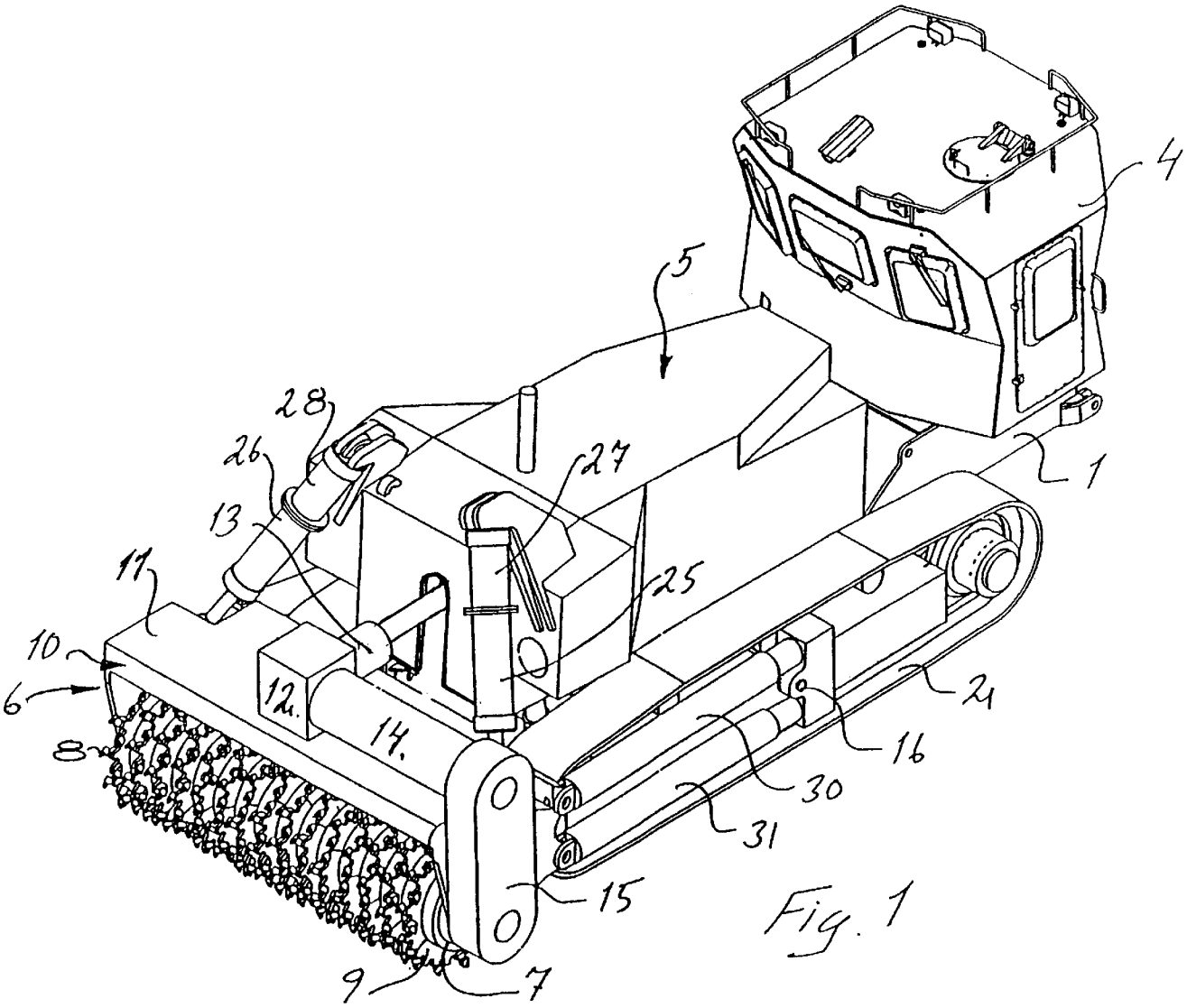
FIG. 1 shows a diagonal projection of a demining vehicle as defined in the present invention.
Figure 2:
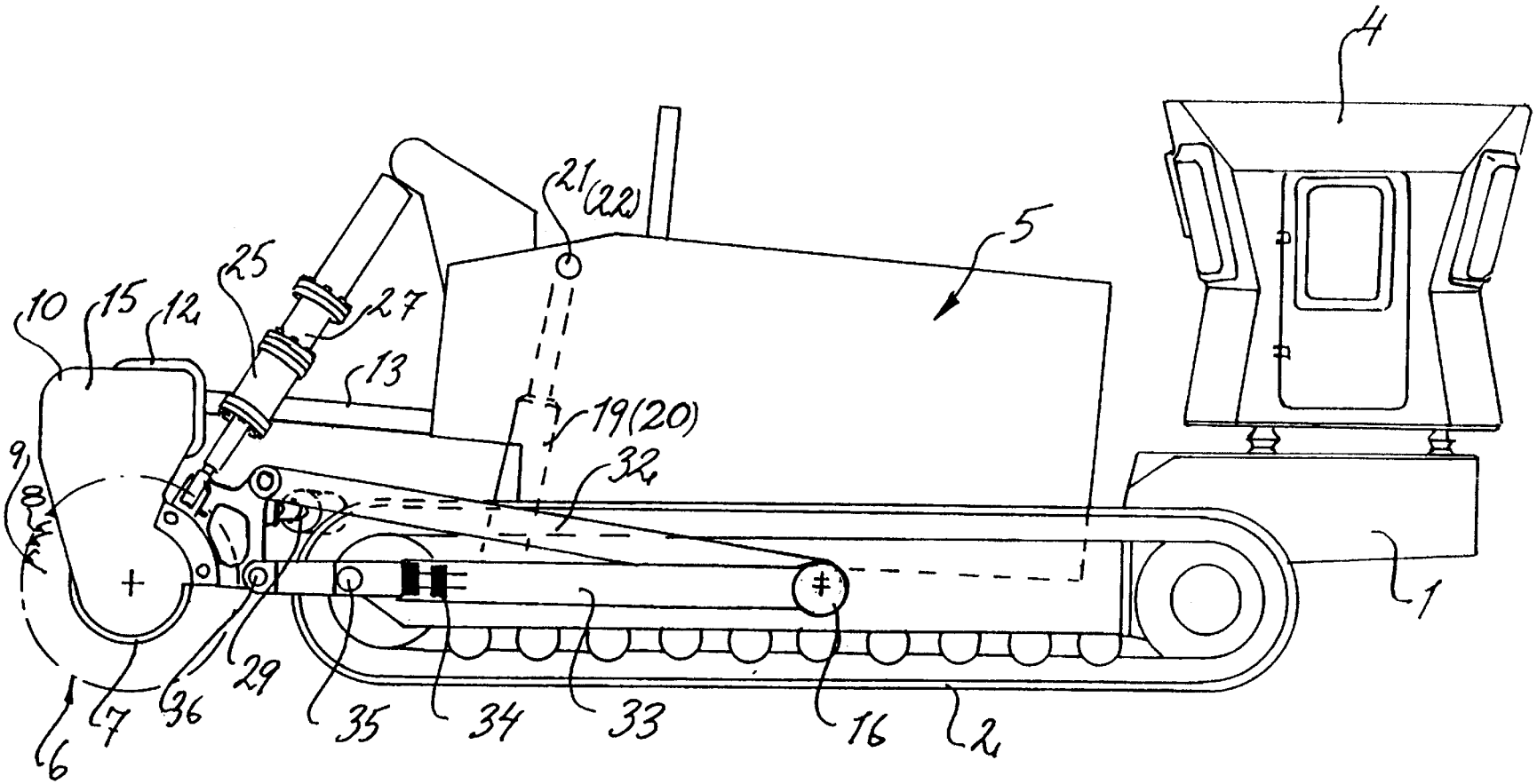
FIG. 2 shows a side projection of the same general vehicle.
Figure 4:
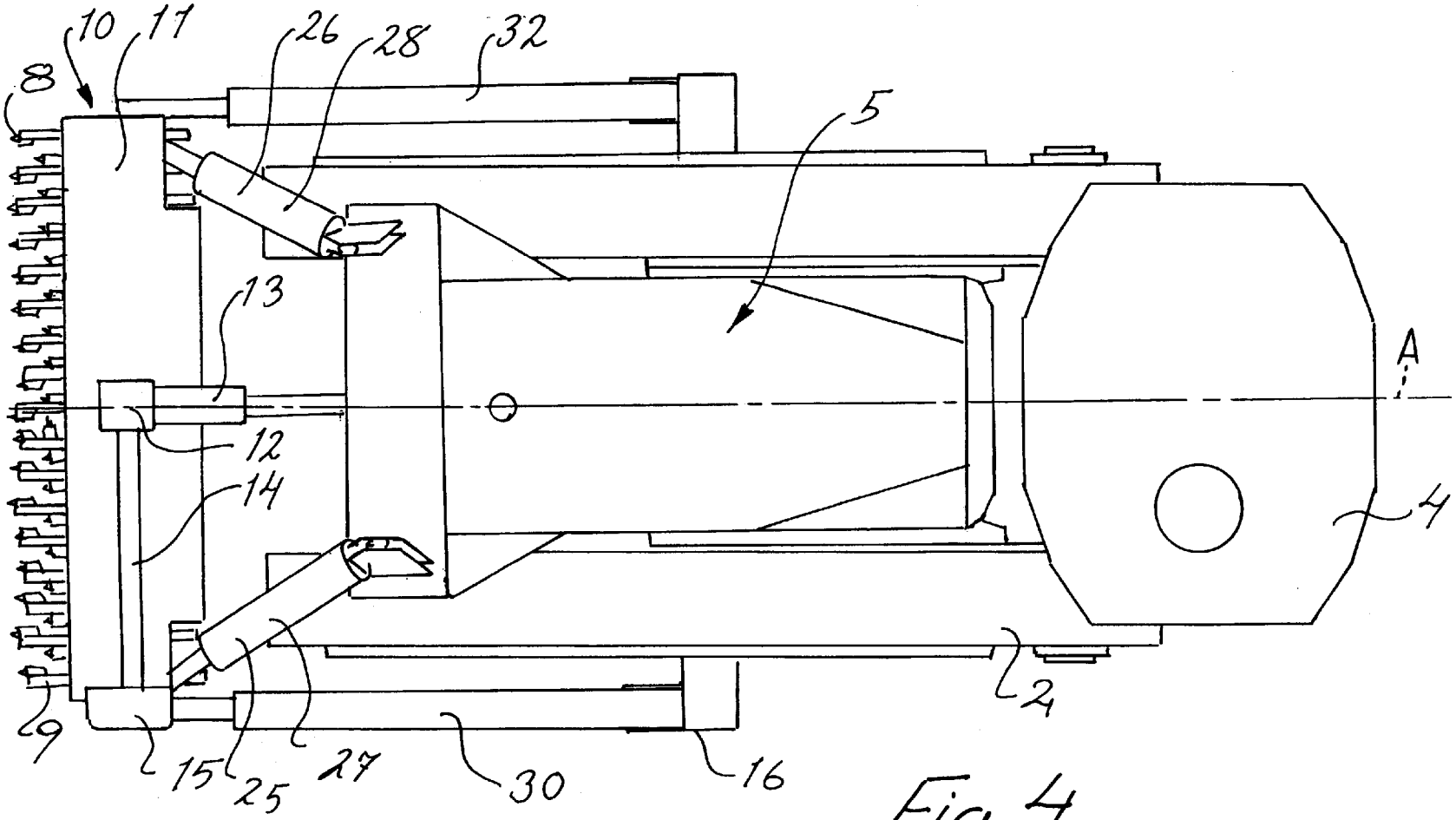
FIG. 4 shows a top projection of the same general vehicle.

As shown in FIG. 4 the roller is divided into disks 9 which have a combined width greater than the width of chassis 1. The demining vehicle in question comprises a chassis 1, two drive tracks 2 and 3, an armoured spring-mounted control cab 4, and an engine compartment 5 incorporating an engine which is not illustrated in detail but which drives the demining vehicle as well as the rotatable demining tool 6 mounted at the front of the vehicle. The demining tool 6 comprises a central, mainly horizontal roller 7 fitted with a large number of demining discs 9 incorporating teeth 8 around their periphery. The demining tool 6 is in turn mounted and journalled for rotation in an inverted cradle 10. As previously mentioned these mounts should preferably be sprung. Level with the horizontal cross-piece 11 of the cradle 10 there is a mitre-wheel gear 12 driven by the engine in the engine compartment via a drive shaft 13. The power output from the mitre-wheel gear 12 is a second drive shaft 14, which may be fitted with a torque limiter, that provides drive to the demining tool 6 at one outer end of the cradle 10 via an enclosed chain-drive 15. FIGS. 1 and 2 illustrate two alternative designs of the enclosure of the mitre-wheel gear 12 and chain-drive 15.

Propulsion of the demining vehicle over the ground is driven, as indicated previously, by the same engine as the demining tool 6, but in the version illustrated in the figures propulsion is via enclosed hydraulic motors.

The demining tool 6 can be raised and lowered and can also be inclined or tilted relative to the horizontal plane by the same motor-driven hydraulics.

As previously described the drive shaft 13 is driven by the engine in the engine compartment 5. Drive shaft 13 drives gear 12 which in turn drives second drive shaft 14 to drive the tool 6 which is mounted in cradle 10. Thus, the various structures such as drive shaft 13, gear 12, drive shaft 14 and cradle 10 might be considered as mounting structure which connects the engine to the demining tool for rotating the demining tool and for creating an interconnected unit of the engine and the demining tool.

As claimed in the present invention the engine compartment 5 (the '5' also denotes the engine therein) and the demining tool 6 and its cradle 10 are interconnected to form a functionally coordinate unit of previously described type in the longitudinal axis of the demining vehicle, which unit is journalled around the transverse shaft 16 which is located transverse to the longitudinal axis A of the vehicle (see FIG. 4).

Figure 3:
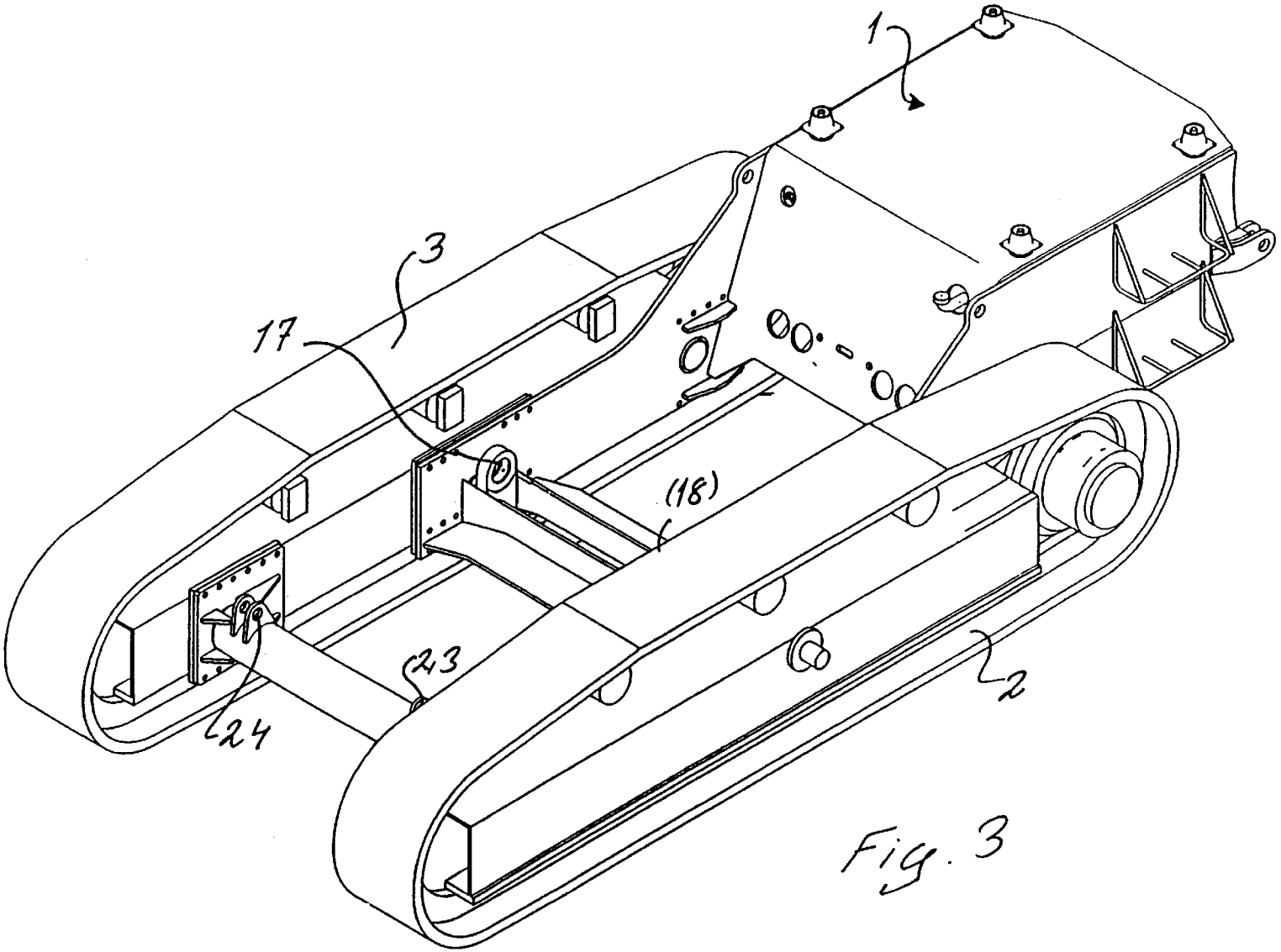
FIG. 3 shows the chassis and drive tracks of the same vehicle.

The transverse shaft 16 mountings on the demining vehicle chassis are designated 17 and 18 in FIG. 3 whereof 18 is concealed from view in the figure.

The combined engine compartment and demining tool unit has its centre of gravity longitudinally ahead of the transverse shaft 16. This means that more than half of the combined weight of the unit is concentrated over the demining tool 6.

There are two hydraulic lift pistons (which could be considered as lift structure) 19 and 20 (20, however, is concealed in the figures) that control the operating depth of the demining tool 6 in the upper ground layer. These two-hydraulic lift pistons incorporate damping functions that dampen the oscillation of the engine compartment and demining tool. The upper mounts 21 and 22 of the hydraulic lift pistons 19 and 20 are located in the combined unit, i.e. inside the engine compartment 5 (22 is concealed in FIG. 2), and the lower mounts 23 and 24 are located on the chassis 1 (see FIG. 3).

The demining tool 6 can also be inclined or tilted relative to the demining vehicle to enable small undulations in the upper ground layer to be followed. Tilting is controlled by two hydraulic tilt pistons 27 and 28 which also incorporate shock absorbers 25 and 26. For lateral control of the cradle 10 of the demining tool 6 there is a further shock absorber 29 mounted between the chassis 1 and the cradle 10 designed to assimilate lateral oscillation between the chassis and cradle.

The cradle 10 of the demining tool 6 is also fitted with lateral supports, different designs of which are shown in FIGS. 1 and 2.

In FIG. 1 the lateral support consists of a pair of tubular lateral supports 30 and 31 located on each side of the demining vehicle that are mounted via journals both in the cradle 10 and in the vehicle chassis level with the transverse shaft 16.

In FIG. 2 the same lateral support function is comprised instead of a rigid beam 32 journalled in the cradle 10 and similarly journalled level with the transverse shaft 16 in which latter mounting point one end of a support beam 33 is also journalled and which incorporates al least one shock absorber 34 and whose other end incorporates a twin link 35 and 36 via which it is mounted on the cradle 10. The purpose of the twin link is to prevent twisting of the roller 7 when it is tilted.

The functioning of the complete demining vehicle is as follows. The operating depth of the demining tool 6 in the upper ground layer is controlled by the hydraulic lift pistons 19 and 20. More than half of the weight of the engine compartment 5 and demining tool 6 and its cradle 10 bear on the demining tool. When the demining tool starts to operate the demining discs 9 work down to the desired depth and as the demining vehicle moves forwards the demining tool works through the upper ground layer. The objective is that mines encountered will either be 'chewed' into small harmless fragments or will be made to detonate. The tilt function enables the demining tool to follow any undulations in the ground so that it operates at a constant depth.

If a large mine such as an anti-vehicle or anti-tank mine is made to detonate in or under the demining tool, the resultant stresses are absorbed by the demining tool 6, partially by the spring mounts in the cradle 10, partially by the shock absorbers 25 and 26 located between the cradle and the engine, and partially by an upswing by the entire engine compartment and demining tool unit.

By means of this arrangement damage to the demining tool 6 is usually restricted to only one or two demining discs 9, even in the case of very powerful mine explosions. and individual demining discs or sections thereof are relatively easy to replace. In an extreme case the complete demining tool 6 can be replaced. What is vital is that there is no damage to the cradle 10 or driveline of the demining tool.

We hereby claim and desire to secure by Letters Patent the following:

1. A demining device for clearing landmines on or in the upper ground layer and down to a predetermined depth thereunder comprising a self-propelled demining vehicle having a chassis and a front part and a longitudinal axis, a demining tool mounted at said front part for operating in the upper ground layer down to a pre-determined distance below the surface of the ground to fragment into harmless pieces or detonate any mine in its path, an engine on said chassis, mounting structure connecting said engine to said demining tool for rotating said demining tool and for creating an interconnected unit of said engine and said demining tool, a transverse shaft extending across said vehicle perpendicular to said longitudinal axis of said vehicle, said unit being pivotally mounted around said transverse shaft, said transverse shaft being located at a position with respect to said longitudinal axis so that said unit has more than half of its weight located ahead of said transverse shaft toward said front part as viewed in the direction of the operation of the vehicle to make said unit front heavy, lift structure between said vehicle chassis and said unit, said lift structure compensating for the front heaviness of said unit, said lift structure further controlling the angle between said vehicle chassis and said unit to determine the operation depth of a demining action in the upper ground layer by said demining tool, and said lift structure being capable of minimizing disturbance of movement of said unit around said transverse shaft which moves said demining tool upwards away from a detonating mine whereby said unit may pivot upwards in a case of a heavy mine detonation under said demining tool.

2. A demining device as claimed in claim 1 wherein said lift structure includes hydraulic lift pistons located between said unit and said chassis ahead of said transverse shaft.

3. A demining device as claimed in claim 2 wherein said demining tool includes a plurality of discs mounted on a roller, said roller being located laterally to the direction of operation and to said longitudinal axis, and said demining tool being mounted for tilting movement to enable said demining tool to follow minor undulations in the ground.

4. A demining device as claimed in claim 3 wherein said mounting structure includes shock absorbers mounted between mounting points of said unit and said chassis to prevent any sudden movements of said unit.

5. A device as claimed in claim 4 wherein said demining tool consists of a roller having a toothed formation at its periphery, said roller being arranged laterally with respect to said longitudinal axis, said roller being divided into discs which have a combined width greater than the width of said chassis, said mounting structure including a drive shaft driven by said engine, said drive shaft being located along said longitudinal axis, said mounting structure including a cradle, said roller being mounted to said cradle, said engine being mounted in an engine compartment, said cradle having end plates which are supported relative to a lateral direction across said longitudinal axis by support guides and shock absorbing devices located between said end plates and said chassis.

6. A device as claimed in claim 5 wherein said mounting structure includes mounts into which said demining tool is journaled to enable rotation of said demining tool with respect to said cradle to thereby assimilate and dampen certain loads caused by detonating mines while said cradle is in turn mounted on said engine compartment by said shock absorbers, and each of said shock absorbers being designed to assimilate and dampen further loads while the combined motion of said unit enables any residual loads from a mine detonation to be dampened.

7. A demining device as claimed in claim 1 wherein said demining tool includes a plurality of discs mounted on a roller, said roller being located laterally to the direction of operation and to said longitudinal axis, and said demining tool being mounted for tilting movement to enable said demining tool to follow minor undulations in the ground.

8. A demining device as claimed in claim 1 wherein said mounting structure includes shock absorbers mounted between mounting points of said unit and said chassis to prevent any sudden movements of said unit.

9. A demining device as claimed in claim 8 wherein said demining tool consists of a roller having a toothed formation at its periphery, said roller being arranged laterally with respect to said longitudinal axis, said roller being divided into discs which have a combined width greater than the width of said chassis, said mounting structure including a drive shaft driven by said engine, said drive shaft being located along said longitudinal axis, said mounting structure including a cradle, said roller being mounted to said cradle, said engine being mounted in an engine compartment, said cradle having end plates which are supported relative to the lateral direction across said longitudinal axis by support guides, and shock absorbing devices located between said end plates and said chassis.

10. A demining device as claimed in claim 9 wherein said mounting structure includes mounts into which said demining tool is journaled to enable rotation of said demining tool with respect to said cradle to thereby assimilate and dampen certain loads caused by detonating mines while said cradle is in turn mounted on said engine compartment by said shock absorbers and each of said shock absorbers being designed to assimilate and dampen further loads while the combined motion of said unit enables any residual loads from a mine detonation to be dampened.

11. A method of mine detonation comprising providing a self-propelled demining vehicle having a chassis and a front part and a longitudinal axis, mounting a demining tool at the front part of the vehicle, mounting an engine on the chassis, interconnecting the engine and chassis by mounting structure to create a unit from the engine and demining tool, mounting the unit for pivotal movement around a transverse shaft which extends across the vehicle perpendicular to said longitudinal axis of the vehicle, locating more than half of the weight of the unit ahead of the transverse shaft toward the front part of the vehicle as viewed in the direction of operation of the vehicle to make the unit front heavy, providing lift structure between the vehicle chassis and unit, compensating for the front heaviness of the unit by operation of the lift structure, controlling the angle between the vehicle chassis and the unit by operation of the lift structure to determine the operation depth of a demining action in an upper ground layer by the demining tool, and arranging the lift structure such that the lift structure minimizes any disturbance of the unit around the transverse shaft to permit the demining tool to move upwards away from a detonating mine and permit the unit to pivot upwards in a case of a heavy mine detonation under the demining tool to thereby minimize the risk of major damage to the demining tool when encountering a heavy mine.

12. A method as claimed in claim 11 including tilting the unit within a certain angle range to follow any minor undulations in the ground surface while the demining vehicle is moving forwards.

13. A method as claimed in claim 12 including dampening sudden movement by the unit through shock absorbers.

14. A method as claimed in claim 13 including tilting the unit relative to the chassis by hydraulic lift pistons arranged between the unit and the chassis to compensate for the front heaviness of the unit.

15. A method as claimed in claim 12 including tilting the unit relative to the chassis by hydraulic lift pistons arranged between the unit and the chassis to compensate for the front heaviness of the unit.

* * * * *